US005823524A

United States Patent [19]

Kawada

[11] Patent Number: 5,823,524

[45] Date of Patent: Oct. 20, 1998

[54] SHEET FEEDER WITH FLEXIBLE FRICTIONAL MEMBER FOR SEPARATING SHEETS

[75] Inventor: Shunichirou Kawada, Tokyo, Japan

[73] Assignee: Riso Kagaku Corporation, Tokyo, Japan

[21] Appl. No.: 522,090

[22] Filed: Aug. 31, 1995

[30] Foreign Application Priority Data

Aug. 31, 1994 [JP] Japan ..... 6-207045

[51] Int. Cl.[6] ..... B65H 3/52

[52] U.S. Cl. ..... 271/124; 271/121

[58] Field of Search ..... 271/121, 124

[56] References Cited

U.S. PATENT DOCUMENTS

| | | | |
|---|---|---|---|
| 1,637,833 | 8/1927 | Mueller | 271/124 |
| 3,219,339 | 11/1965 | Gutierrez | 271/11 |
| 3,539,179 | 11/1970 | Bergman | 271/124 |
| 4,526,358 | 7/1985 | Ura et al. | 271/122 |
| 4,674,737 | 6/1987 | Murayoshi | 271/124 |
| 4,982,942 | 1/1991 | Konishi et al. | 271/121 |
| 5,102,115 | 4/1992 | Takamizawa et al. | 271/124 |
| 5,163,668 | 11/1992 | Winship et al. | 271/121 |
| 5,370,381 | 12/1994 | Winship et al. | 271/124 |

FOREIGN PATENT DOCUMENTS

| | | | |
|---|---|---|---|
| A10445029 | 9/1991 | European Pat. Off. | B65H 3/52 |
| 2719182 | 11/1978 | Germany | B65H 3/52 |
| 113048 | 7/1983 | Japan | 271/124 |
| 162437 | 7/1986 | Japan | 271/124 |
| 403267231 | 11/1991 | Japan | 271/124 |
| 406009089 | 1/1994 | Japan | 271/121 |

*Primary Examiner*—William E. Terrell
*Assistant Examiner*—Khoi H. Tran
*Attorney, Agent, or Firm*—Sughrue, Mion, Zinn, Macpeak & Seas, PLLC

[57] ABSTRACT

A sheet feeder includes: a rotatable sheet separation roll having an outer circumferential surface, a pressing member urged onto the outer circumferential surface of the sheet separation roll; and a flexible frictional member having a plate shape interposed between the sheet separation roll and the pressing member, the flexible frictional member being supported at one end portion upstream of the pressing member and the sheet separation roll in a sheet feed direction, wherein a surface of the pressing member confronting the sheet separation roll projects toward the sheet separation roll in a section thereof perpendicular to an axial line of the sheet separation roll.

5 Claims, 6 Drawing Sheets

SHEET FEEDER WITH FLEXIBLE FRICTIONAL MEMBER FOR SEPARATING SHEETS

BACKGROUND OF THE INVENTION

1. Field of the Invention

The invention relates to a sheet feeder used for a printing apparatus and a copying machine to separate sheets on a sheet feed tray on a single sheet basis.

2. Description of the Related Art

FIG. 6 shows a conventional sheet feeder. A separation plate 2 is pressed onto a sheet separation roll 6 by a spring 4. A sheet 12 piled up on a sheet feed tray is fed between the sheet separation roll 6 and the separation plate 2 as to be separated from the rest of the sheets on the tray and forwarded downstream in the sheet forward direction.

A switch spring 8 is coupled to a lower part of the separation plate 2. Both the separation plate 2 and the switch spring 8 can move vertically together. If a plurality of sheets are fed together between the separation plate 2 and the sheet separation roll 6, the separation plate 2 is lowered and the switch spring 8 pushes an actuator 10*a* of a switch 10 for sensing the feeding of a plurality of sheets together to stop the feeding of the sheets.

Such a conventional sheet feeder can separate sheets without a problem when two sheets are fed together. However, when three or more sheets are fed together, the sheet in contact with the separation plate may separate from the rest of the sheets, but the rest of the sheets do not separate, making it likely that the rest of the sheets are fed together. To prevent the feeding of a plurality of sheets together, the pressing force of the separation plate with respect to the sheet separation roll could be increased so that the separation plate can be abutted against the sheet separation roll with a stronger pressing force. However, increasing the pressing force prevents smooth threading of the sheets from the sheet feed tray, which in turn can cause idle feeding in which sheets are not fed from the sheet feed tray.

SUMMARY OF THE INVENTION

The invention has been made in view of the aforementioned circumstances.

The object of the invention is, therefore, to provide a sheet feeder capable of effectively preventing the feeding of a plurality of sheets together without having to increase the pressing force of the separation plate with respect to the sheet separation roll.

According to a first aspect of the present invention, there is provided a sheet feeder which includes: a sheet separation roll having an outer circumferential surface, the sheet separation roll being driven to rotate; a pressing member pushing the outer circumferential surface of the sheet separation roll; and a flexible frictional member having a plate shape interposed between the sheet separation roll and the pressing member, the flexible frictional member being supported at one end portion thereof on an upstream side in a sheet feed direction, wherein a surface of the pressing member confronting the sheet separation roll projects toward the sheet separation roll in a section thereof perpendicular to an axial line of the sheet separation roll.

According to a second aspect of the invention, there is provided the sheet feeder of the first aspect, wherein the flexible frictional member is supported so as to reciprocate a predetermined distance in the sheet feed direction.

According to a third aspect of the invention, there is provided the sheet feeder of the second aspect, further including a movable member arranged on the upstream side in the sheet feed direction with respect to the sheet separation roll and the pressing member, the movable member being movable within a predetermined range and being urged in such a direction as to move away from the sheet separation roll and the pressing member, wherein the flexible frictional member has one end thereof attached to the movable member to reciprocate the movable member the predetermined distance in the sheet feed direction.

According to a fourth aspect of the invention, there is provided the sheet feeder of the third aspect, wherein the movable member is vertically movable within a predetermined range and is urged downward by its own weight.

According to a fifth aspect of the invention, there is provided the sheet feeder of the third aspect, further including a spring, wherein the movable member is vertically movable within a predetermined range and is urged downward by the spring.

A sheet fed between the upper surface of the platelike flexible frictional member and the sheet separation roll is reliably separated from one sheet to another at this position and forwarded downstream in the sheet forward direction. If only a single sheet is fed between the platelike flexible frictional member and the sheet separation roll, the sheet separation angle of the platelike flexible frictional member becomes almost constant in the vicinity of a portion at which the platelike flexible frictional member comes in contact with the sheet separation roll. Further, if two or more sheets are fed together between the platelike flexible frictional member and the sheet separation roll, the sheet separation angle of the platelike flexible frictional member in the vicinity of the portion at which the platelike flexible frictional member comes in contact with the sheet separation roll gradually decreases as the sheet stays further away from the portion of contact toward the upstream side in the sheet feed direction. In addition, the degree of change in the sheet separation angle increases with an increasing number of sheets fed together. As a result, the movement of two or more sheets fed together is blocked with the head ends of the sheets being abutted against the platelike flexible frictional member sequentially from the lowest sheet upward as the sheets approach the portion of contact between the platelike flexible frictional member and the sheet separation roll. Therefore, only the uppermost single sheet can be reliably separated from the rest of the sheets and forwarded. Since the platelike flexible frictional member is elastically deformed so as to correspond to the thickness of the sheet, it is not necessary to adjust the pressing force of the pressing member even if sheets of different thicknesses are used.

DETAILED DESCRIPTION OF THE PREFERRED EMBODIMENTS

Figure 1:
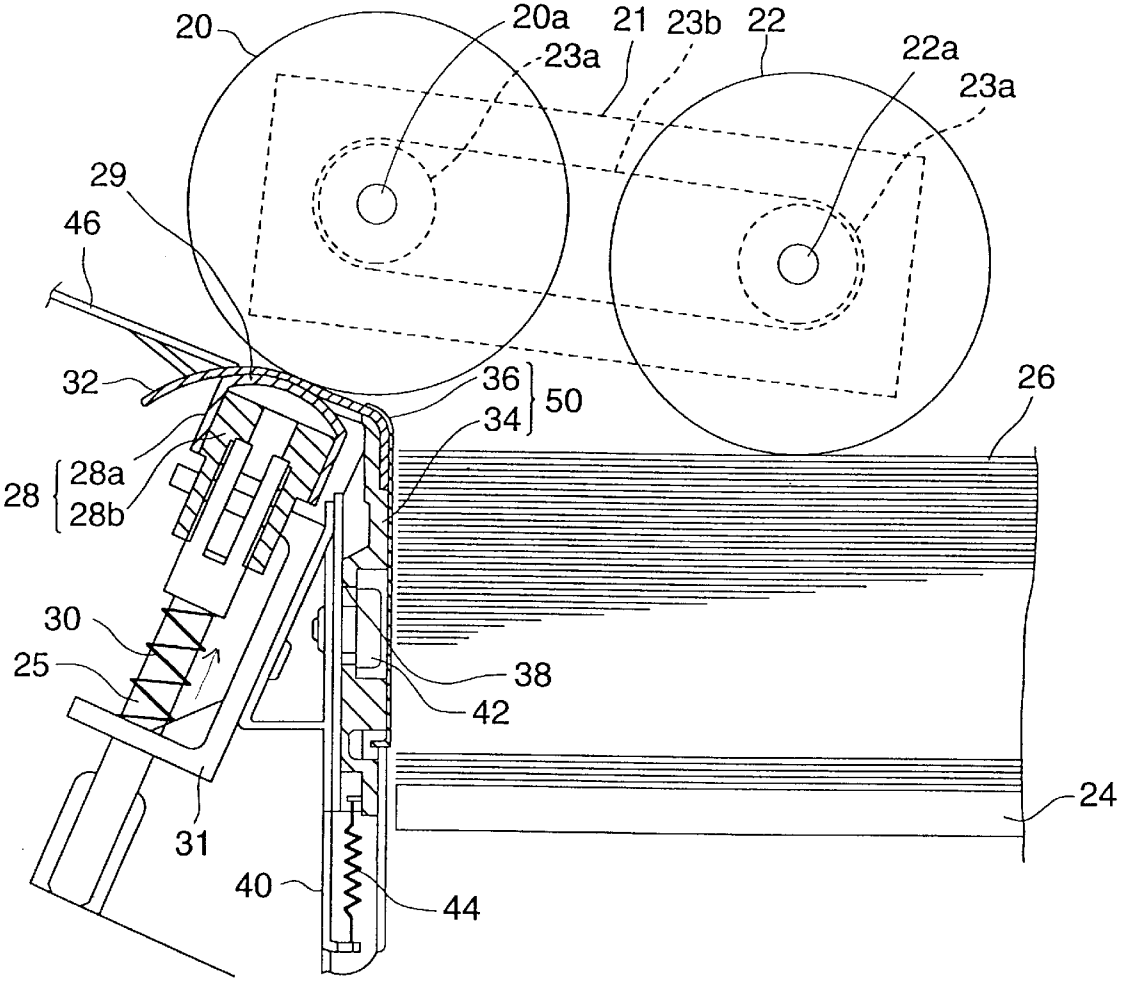
FIG. 1 is a side sectional view showing a sheet feeder according to an embodiment of the invention.
Figure 2:
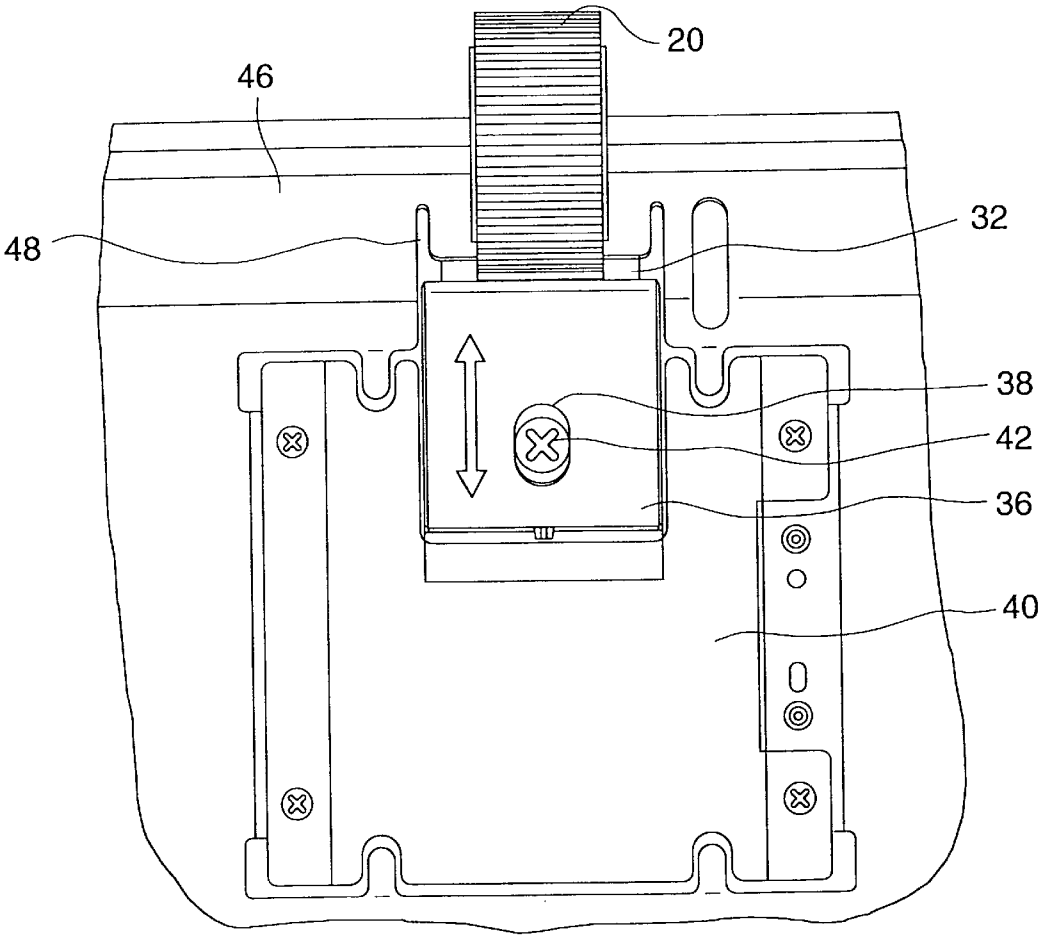
FIG. 2 shows the sheet feeder of FIG. 1 as viewed from the upstream side in the sheet forward direction.

An embodiment of the invention will now be described with reference to FIGS. 1 to 5.

A sheet separation roll 20 and a sheet feed roll 22 are supported by center shafts 20*a* and 22*a*, respectively. The respective center shafts 20*a* and 22*a* are supported by a frame body 21 and can move so as to be interlocked through pulleys 23*a* and a belt 23*b*. If the center shaft 20*a* or 22*a* is rotated by drive means (not shown), then the sheet separation roll 20 and the sheet feed roll 22 are driven to rotate in the same direction in synchronism with each other.

Further, the frame body 21 is designed so that the sheet feed roll 22 side of the frame body 21 is pivotable about the center shaft 20*a* of the sheet separation roll 20. Biasing means (not shown) urges the sheet feed roll 22 side of the frame body 21 downward, so that the sheet feed roll 22 comes in contact with the upper surface of a sheet 26 under a predetermined pressure. A sheet feed tray 24 holds the sheets 26 at a sheet feed position with the sheet feed roll 22 while sequentially lifting the sheets 26 placed thereon upward.

Figure 3:
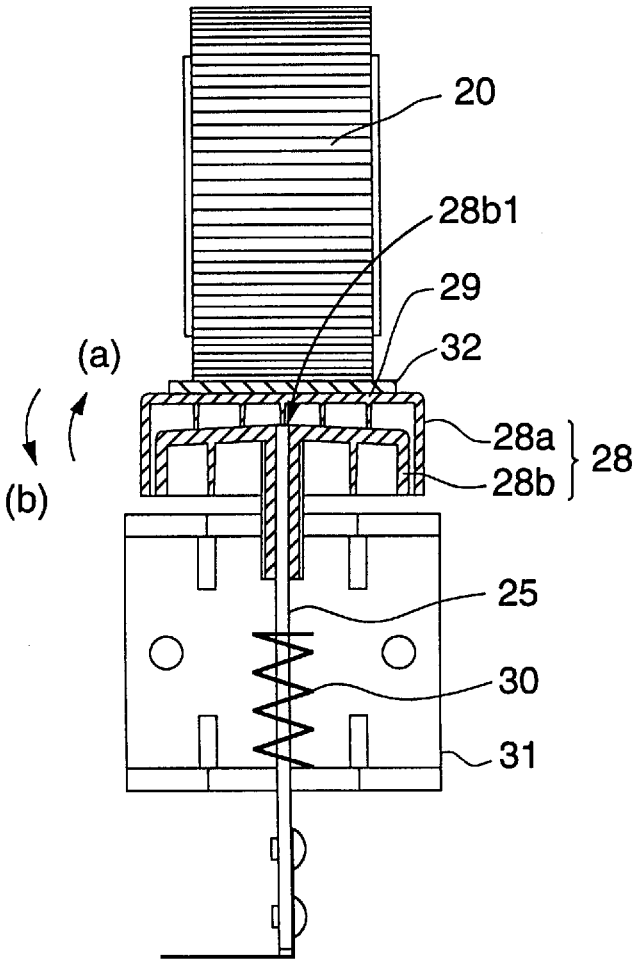
FIG. 3 shows a sheet separation roll and a pressing member of the sheet feeder of FIG. 1.

A pressing member 28 has a substantially boxlike support portion 28*b* and a cap portion 28*a* that is put on the support portion 28*b*. The support portion 28*b* has an upper surface that is downwardly sloped from the center to both sides as viewed from the upstream side in the sheet forward direction as shown in FIG. 3. A gap is provided between the outer side wall surface of the support portion 28*b* and the inner side wall surface of the cap portion 28*a*, and the lower portion of the cap portion 28*a* is formed so that the cap portion 28*a* is pivotable at a slight angle in a direction indicated by an arrow (a) or (b) with a ridgeline 28*b* 1 of the support portion 28*b* as a fulcrum.

As shown in FIG. 1, an upper surface 29 of the cap portion 28*a* is formed so as to project toward the sheet separation roll 20 in a section perpendicular to the axial line of the sheet separation roll 20.

A support shaft 25 is fixed to the bottom of the support portion 28*b*. A support bracket 31 is fixed to a support plate 40 arranged below the sheet separation roll 20. The support shaft 25 passes through the support bracket 31, and a spring 30 serving as pressing means is interposed between the support shaft 25 and the support bracket 31. The spring 30 urges the pressing member 28 against the sheet separation roll 20.

A movable member 50 is arranged on the upstream side of the sheet separation roll 20 and the pressing member 28 in the sheet feed direction. The movable member 50 can move vertically within a predetermined range. The movable member 50 has plate members 34, 36 that are coupled to each other. The plate member 34 has a vertically elongated hole 38 formed in the middle of the surface thereof. A screw 42 is attached to the support plate 40 through this elongated hole 38. A spring 44 serving as a biasing member is interposed between the plate member 34 and the support plate 40, so that the plate member 34 is biased downward. With this arrangement, the movable member 50 is urged downward so as to be set to the lower limit within a range determined by the length of the elongated hole 38. When the movable member 50 is pulled upward resisting the urging force of the spring 44, the movable member 50 can move upward along the elongated hole 38. Upon removal of such upwardly pulling force, the movable member 50 is returned to the original lower limit.

An elastic pad 32 serving as a platelike flexible frictional member is made of an elastic material such as rubber having a predetermined frictional coefficient, and is interposed between the sheet separation roll 20 and the pressing member 28. An end of the elastic pad 32 that is located on the upstream side with respect to the sheet separation roll 20 and the pressing member 28 in the sheet feed direction is fixedly interposed between the plate members 34, 36 of the movable member 50.

When the sheet separation roll 20 rotates, a sheet 26 is nipped between the sheet separation roll 20 and the elastic pad 32, and is then urged forward. The elastic pad 32 is pulled in the sheet feed direction, and the movable member 50 is raised. A downwardly urging force is applied to the movable member 50 at all times, and an appropriate frictional force is therefore applied to the sheet 26 being fed at all times.

A guide plate 46 for guiding the forwarded sheet 26 is arranged on the downstream side of the sheet separation roll 20 and the pressing member 28 in the sheet feed direction. A slit 48 is formed in a portion of the guide plate 46 adjacent to the sheet separation roll 20. The other end of the elastic pad 32 is inserted into this slit 48.

The operation of the thus constructed sheet feeder will be described.

The sheet 26 having been fed by the sheet feed roll 22 is moved forward between the sheet separation roll 20 and the elastic pad 32. The projecting upper surface of the pressing member 28 urges the elastic pad 32 onto the circumferential surface of the sheet separation roll 20. In addition, since the elastic pad 32 is movable downstream in the sheet feed direction, frictional forces are appropriately applied between the sheet separation roll 20 and the sheet 26 being fed, and between the elastic pad 32 and the sheet 26. Accordingly, the sheet 26 can be moved forward smoothly.

Further, the cap portion 28*a* of the pressing member 28 is pivotable with respect to the support portion 28*b* within a perpendicular plane to the sheet: 26 feed direction. Therefore, a widthwise inclination error of the sheet occurring when the sheet is being fed from the sheet feed roll 22 can be absorbed to thereby allow the sheet to be separated properly.

Figure 4:
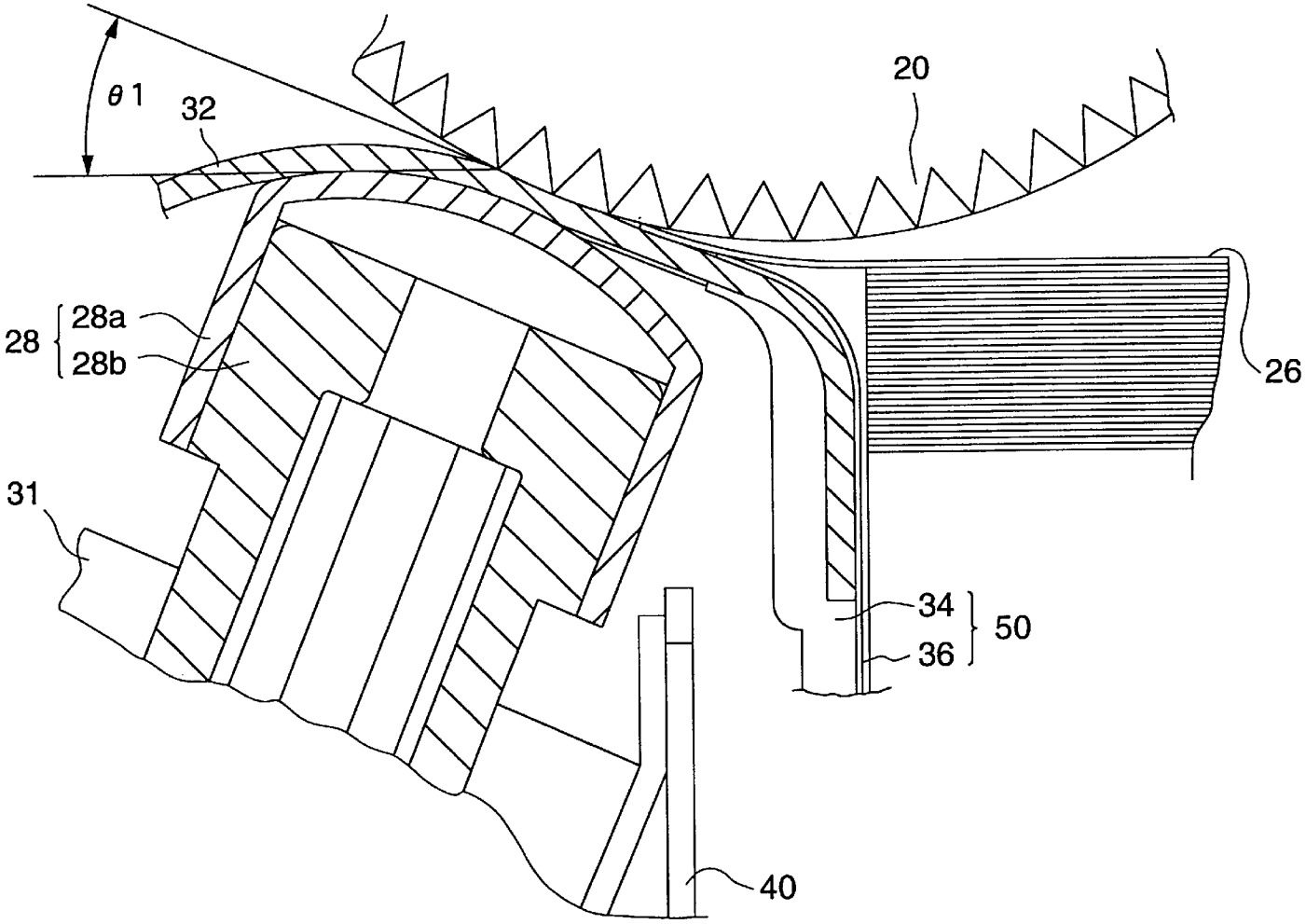
FIG. 4 shows an operation of separating a sheet in the sheet feeder of FIG. 1.

FIG. 4 shows a normal sheet feeding state in which a single sheet 26 is fed between the elastic pad 32 and the sheet separation roll 20. An angle θ formed by the upper surface of the elastic pad 32 with respect to the horizontal surface, i.e., a sheet separation angle, is almost constant in the vicinity of a portion at which the elastic pad 32 comes in contact with the sheet separation roll 20. For example, θ1 is about 21° in FIG. 4.

Figure 5:
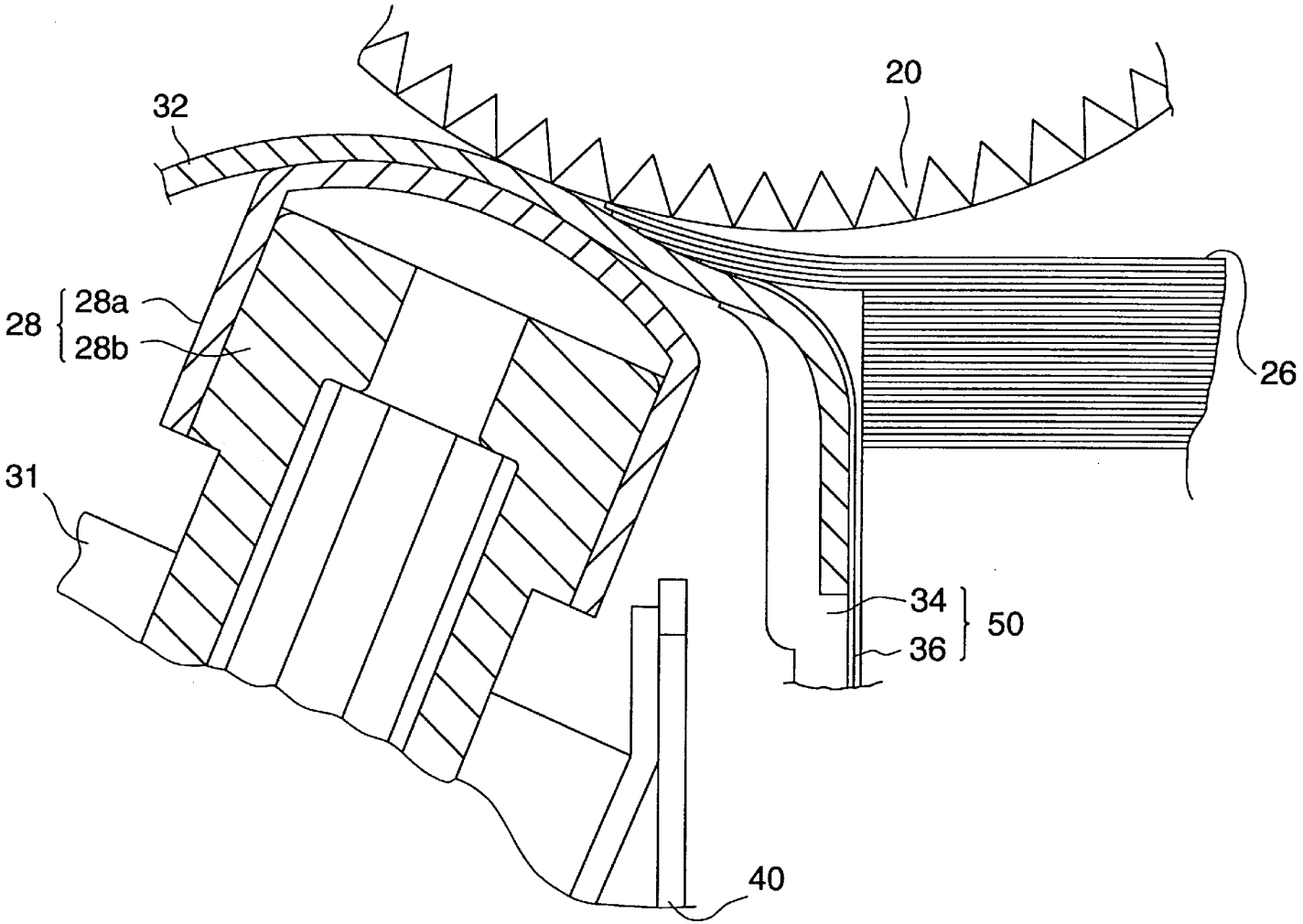
FIG. 5 shows an operation of separating a sheet in the sheet feeder of FIG. 1.
Figure 6:
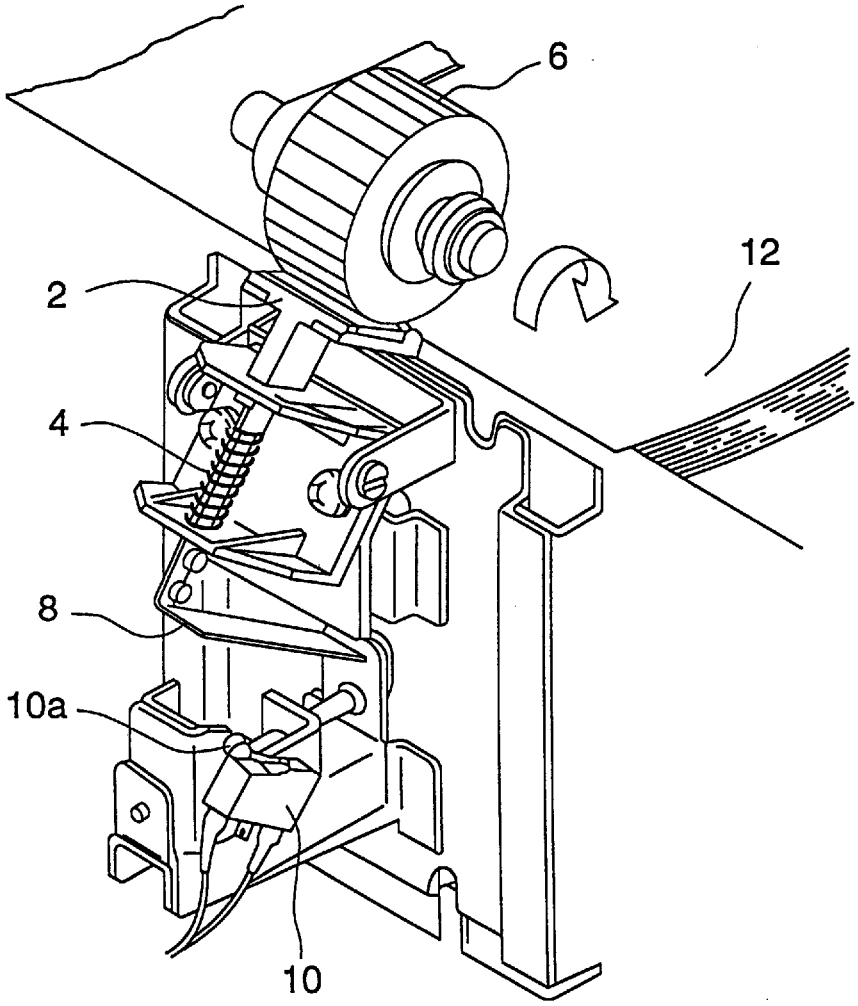
FIG. 6 PRIOR ART
FIG. 6 is a perspective view showing a conventional sheet feeder.

FIG. 5 shows a state in which a plurality of sheets 26 are fed. If two or more sheets 26 are fed between the elastic pad 32 and the sheet separation roll 20, the sheet separation angle of the elastic pad 32 in the vicinity of the portion at which the elastic pad 32 comes in contact with the sheet separation roll 20 gradually decreases as the sheet stays further away from the portion of contact toward the upstream side in the sheet feeding direction. In FIG. 5, five sheets 26 are fed together. The sheet separation angles for the second, third, and fourth sheets are about 34°, 33°, and 32°, respectively. Hence, the sheet separation angle for feeding a plurality of sheets together is larger than that for feeding a single sheet. In addition, the degree of change in the sheet separation angle is increased with an increasing number of sheets fed together.

The movement of two or more sheets 26 fed together is blocked with the head ends of the sheets abutted against the surface of the elastic pad 32 sequentially from the lowest sheets upward as the sheets approach the portion of contact between the elastic pad 32 and the sheet separation roll 20, and only the uppermost single sheet is reliably separated from the rest of the sheet and forwarded.

While an urging force opposite to the sheet 26 forward direction is applied to the elastic pad 32 by urging the movable member 50 downward with the spring 44, a similar effect can be obtained by the weight of the movable member 50 without using the spring 44. In addition, if the elastic pad 32 is made immovable by fixing the plate member 34 to the support plate 40, then the entire construction of the sheet feeder can be simplified. In this case, also, by causing the pressing member 28 to urge the elastic pad 32 onto the sheet separation roll 20 with the projecting upper surface of the pressing member 28, the advantage of reliably separating only the uppermost single sheet from two or more sheets fed together and forwarding that single sheet can be obtained.

Further, although in the above-described embodiment a sheet is fed between the sheet separation roll 20 and the elastic pad 32 using the sheet feed roll 22, the sheet may be fed between the sheet separation roll and the elastic pad by the sheet separation roll itself if the head end of the sheet comes in contact with the sheet separation roll, thus dispensing with the sheet feed roll.

According to the sheet feeder of the invention, a platelike flexible frictional member is interposed between the sheet separation roll and the pressing member whose upper surface is projecting, so that the head ends of a plurality of sheets fed together come in contact with the platelike flexible frictional member without fail, thereby allowing only the uppermost single sheet to be reliably separated from the rest of the sheets and forwarded. Therefore, the feeding of a plurality of sheets together can be effectively prevented without having to increase the pressing force of the pressing member onto the sheet separation roll. Consequently, sheet feeding performance can be improved.

What is claimed is:

1. A sheet feeder for feeding a sheet in a sheet feed direction, comprising:

a sheet separation roll having an outer circumferential surface, said sheet separation roll being drivable to rotate;

a pressing member urged onto said outer circumferential surface of said sheet separation roll;

a flexible frictional member having a plate shape interposed between said sheet separation roll and said pressing member, said flexible frictional member being supported at one end portion thereof by a biasing means upstream in said sheet feed direction with respect to said pressing member; and a moveable member arranged upstream in the sheet feed direction with respect to said sheet separation roll and said pressing member, said movable member being movable within a predetermined range and being urged in such a direction as to move away from said sheet separation roll and said pressing member, wherein a surface of said pressing member confronting said flexible frictional member projects toward said sheet separation roll, wherein said flexible frictional member is supported so as to reciprocate a predetermined distance in the sheet feed direction, wherein said one end of said flexible frictional member is attached to said movable member to reciprocate said movable member the predetermined distance in the sheet feed direction, and wherein said movable member is vertically movable within a predetermined range and is urged downwardly by self weight.

2. A sheet feeder according to claim 1, wherein said flexible frictional member is made of rubber.

3. A sheet feeder according to claim 2, wherein a gap is provided between an outer side surface of said support portion and an inner side surface of said cap portion, and wherein said cap portion is pivotable within a plane perpendicular to the sheet feed direction.

4. A sheet feeder for feeding a sheet in a sheet feed direction, comprising:

a sheet separation roll having an outer circumferential surface, said sheet separation roll being drivable to rotate;

a pressing member urged onto said outer circumferential surface of said sheet separation roll;

a flexible frictional member having a plate shape interposed between said sheet separation roll and said pressing member, said flexible frictional member being supported at one end portion thereof by a biasing means upstream in said sheet feed direction with respect to said pressing member; and a moveable member arranged upstream in the sheet feed direction with respect to said sheet separation roll and said pressing member, said movable member being movable within a predetermined range and being urged in such a direction as to move away from said sheet separation roll and said pressing member, wherein a surface of said pressing member confronting said flexible frictional member projects toward said sheet separation roll, wherein said flexible frictional member is supported so as to reciprocate a predetermined distance in the sheet feed direction, wherein said one end of said flexible frictional member is attached to said movable member to reciprocate said movable member the predetermined distance in the sheet feed direction, and wherein said biasing means comprises a spring, and wherein said movable member is vertically movable within a predetermined range and is urged downward by said spring.

5. A sheet feeder for feeding a sheet in a sheet feed direction, comprising:

a sheet separation roll having an outer circumferential surface, said sheet separation roll being drivable to rotate;

a pressing member urged onto said outer circumferential surface of said sheet separation roll; and a flexible frictional member having a plate shape interposed between said sheet separation roll and said pressing member, said flexible frictional member being supported at one end portion thereof by a biasing means upstream in said sheet feed direction with respect to said pressing member, wherein a surface of said pressing member confronting said flexible frictional member projects toward said sheet separation roll, wherein said flexible frictional member is supported so as to reciprocate a predetermined distance in the sheet feed direction, wherein said pressing member includes a support portion and a cap portion disposed on said support portion, said support portion having an upper surface that is downwardly sloped from its center to both its outer sides as viewed from upstream of said pressing member in the sheet feed direction.

* * * * *